US005327925A

United States Patent [19]

Ortel

[11] Patent Number: 5,327,925

[45] Date of Patent: Jul. 12, 1994

[54] VALVE SERVICE BOX AND METHOD OF MAKING

[76] Inventor: Thomas L. Ortel, 76 Tremont, Kenmore, N.Y. 14217

[21] Appl. No.: 166,727

[22] Filed: Dec. 14, 1993

[51] Int. Cl.[5] ..... F16L 55/18; F16L 9/00

[52] U.S. Cl. ..... 137/15; 137/366; 137/368; 137/371

[58] Field of Search ..... 137/371, 368, 364, 365-367, 137/369, 370, 15

[56] References Cited

U.S. PATENT DOCUMENTS

| | | | |
|---|---|---|---|
| 407,955 | 7/1889 | Kallaher et al. . | |
| 616,542 | 12/1898 | Koehne | 137/366 |
| 2,099,479 | 11/1937 | Heinkel et al. | 137/367 |
| 2,691,384 | 10/1954 | Mueller et al. | 137/366 |
| 2,828,762 | 4/1958 | Swank | 137/371 |
| 2,931,383 | 4/1960 | Handley | 137/369 |
| 3,548,864 | 12/1990 | Handley et al. . | |
| 3,561,470 | 2/1971 | Hawle | 137/371 |
| 3,746,034 | 7/1973 | Cosson | 137/364 |
| 4,691,733 | 9/1987 | Zinn | 137/371 |

FOREIGN PATENT DOCUMENTS

| | | | |
|---|---|---|---|
| 4773 | 11/1922 | Switzerland | 137/368 |
| 21560 | of 1903 | United Kingdom | 137/371 |
| 521427 | 5/1940 | United Kingdom | 137/371 |

OTHER PUBLICATIONS

Bibby Foundry Ltd. B-3000 Service Box, May 1984.

*Primary Examiner*—A. Michael Chambers
*Attorney, Agent, or Firm*—John C. Thompson

[57] ABSTRACT

A kit for forming a valve service box (10). The kit includes a plastic service valve housing (24) and a cover box assembly (22). The cover box assembly includes a plastic cover housing (32). Each of the housings (24 and 32) is provided with a cylindrical smooth wall bore (24.21 or 32.21) which may closely receive one end of a length of polyvinyl chloride pipe (26) of an appropriate uniform diameter. The housings (24 and 32) can be bonded by a conventional solvent welding process to the piece of plastic pipe (26) to form the valve service box, the plastic pipe (26) having been cut in the field to be of a correct length.

8 Claims, 5 Drawing Sheets

VALVE SERVICE BOX AND METHOD OF MAKING

TECHNICAL FIELD

The present invention relates generally to valve service boxes, and more particularly to a kit for making such a box, the kit having a plastic service valve housing and a cover box assembly which includes a plastic cover housing, the housings capable of being bonded to a piece of plastic pipe of an appropriate uniform diameter to form a valve service box, the plastic pipe having been cut in the field to be of a correct length.

BACKGROUND OF THE INVENTION

A water or gas main is connected to a building, such as a residential house, via a service line which extends from the main to the building below the frost line. The service line is provided with a service line shut-off valve assembly, typically near the curb. In order to turn the water or gas supply to the structure either "on" or "off" a valve service box is provided. The valve service box has a service valve housing disposed about the shut-off valve assembly, a cover, and a tubular structure which extends between the cover and the service valve housing. When the cover is removed, a conventional rod key may be passed through the tubular structure and the service valve housing for turning the water or gas supply "on" or "off".

A common form of service box in use today has top and bottom cast iron sections. The bottom section includes a service valve housing and an integral upwardly extending cylindrical portion provided with external threads. The top cast iron section includes a cylindrical housing having an outwardly extending flange near its top upon which may rest a downwardly extending flange of a metal cover, the cover being secured to the top section by a suitable fastener in the form of a bolt which passes through an aperture in the top and which is screwed into an inwardly extending flange portion on the top section. The lower portion of the cylindrical housing of the top section is provided with internal threads which may cooperate with the threads on the bottom section so that the overall length of the service box may be varied. While this form of service box is widely accepted, it requires the installer of service boxes to have a number of differing sizes in stock as the service pipe shut-off valve assemblies may be disposed at varying distances below ground surface. Thus, one manufacturer provides four different lengths of bottom sections and three different lengths of top sections. Representative examples of cast iron service boxes are shown in U.S. Pat. Nos. 407,955 and 2,099,479.

While cast iron devices hold up quite well in use, they have the disadvantage in that they are relatively heavy and are subject to corrosion. To this end it has been proposed to form valve service boxes of material other than cast iron. Examples are shown in U.S. Pat. Nos. 3,746,034 and 4,691,733. In these patents the telescoping screw adjusted top and bottom cylindrical sections are formed of a suitable non-metallic material, such as polyethylene. While these patents also use threaded top and bottom sections, it is well know that other means may be employed for adjusting the length between the top cover and the bottom bell housing. U.S. Pat. No. 2,931,383 shows a valve service box formed of a non-metallic material such as cellulose, acetate, butyrate, acrylonitrile, a rubber molding compound, or the like.

This valve service box includes as its principal components an upper tubular section telescoped within a lower tubular section, and a bell housing which is cemented to the lower end of the lower tubular section. The upper and lower tubular sections are secured to each other by a set screw or the like. A more recent patent to the same inventor is U.S. Pat. No. 3,548,864 which discloses a somewhat similar structure. However, the lower tubular section and the bell housing are formed as single integral piece, and the upper tubular section is telescoped within the lower tubular section and is held from longitudinal movement by friction means.

While some of the more recent patents overcome the disadvantages of corrosion and the weight of a cast iron valve service boxes, they still have the disadvantage of requiring a number of upper and lower telescoping tubular members of different lengths in order to meet differing length requirements. This requires the installer to have a larger inventory of parts than would be necessary than with the present invention.

OBJECTS OF THE INVENTION

It is an object of the present invention to provide a kit for forming a valve service box, the kit including a plastic service valve housing and a cover box assembly, which housing and cover box assembly may be assembled in the field with a length of plastic pipe of a suitable uniform diameter, which pipe has been cut to the proper length in the field to form a valve service box for a service pipe shut-off valve assembly disposed below the surface of the ground.

It is also an object of the present invention to provide a novel cover box assembly and a novel plastic valve service housing which may be used in a kit for forming valve service boxes.

It is a further object of the present invention to provide a novel cover box assembly which includes a plastic cover housing having a lower cylindrical smooth wall bore adapted to closely receive the upper end of a length of plastic pipe for coupling thereto by a conventional solvent welding process, the plastic cover housing also having a radially inwardly extending stop abutment disposed immediately above the lower cylindrical smooth wall bore, which abutment acts to limit the amount the upper end of a plastic pipe can be inserted within the plastic cover housing prior to bonding thereto.

It is a yet another object of the present invention to provide a one piece integral plastic service valve housing for a valve service box forming kit of the type set forth above, which integral plastic service valve housing includes an upper portion having a cylindrical smooth wall bore which is adapted to receive therein the lower end of a length of plastic pipe of an appropriate diameter for coupling thereto by a conventional solvent welding process, the plastic valve service housing having a radially inwardly extending stop abutment disposed immediately below the cylindrical smooth wall bore, which abutment acts to limit the amount that the lower end of the plastic pipe can be inserted into service valve housing prior to being bonded thereto.

It is also an object of the present invention to provide a kit including only a service valve housing and an cover box assembly which can be assembled in the field to a length of plastic pipe of a suitable uniform diameter, the process of assembling including the steps of cutting the length of plastic pipe so that it will be of the desired length between the surface of the ground and the service valve housing when properly positioned about the shut-off valve below the surface of the ground, and the further steps of bonding one end of the length of the pipe within the upper cylindrical smooth wall bore of the service valve housing and bonding the lower cylindrical smooth wall bore of the plastic cover housing to the upper end of the plastic pipe to form a valve service box.

The foregoing objects and other objects and advantages of the present invention will become more apparent after a consideration of the following detailed description taken in conjunction with the accompanying drawings.

DETAILED DESCRIPTION

Figure 5:
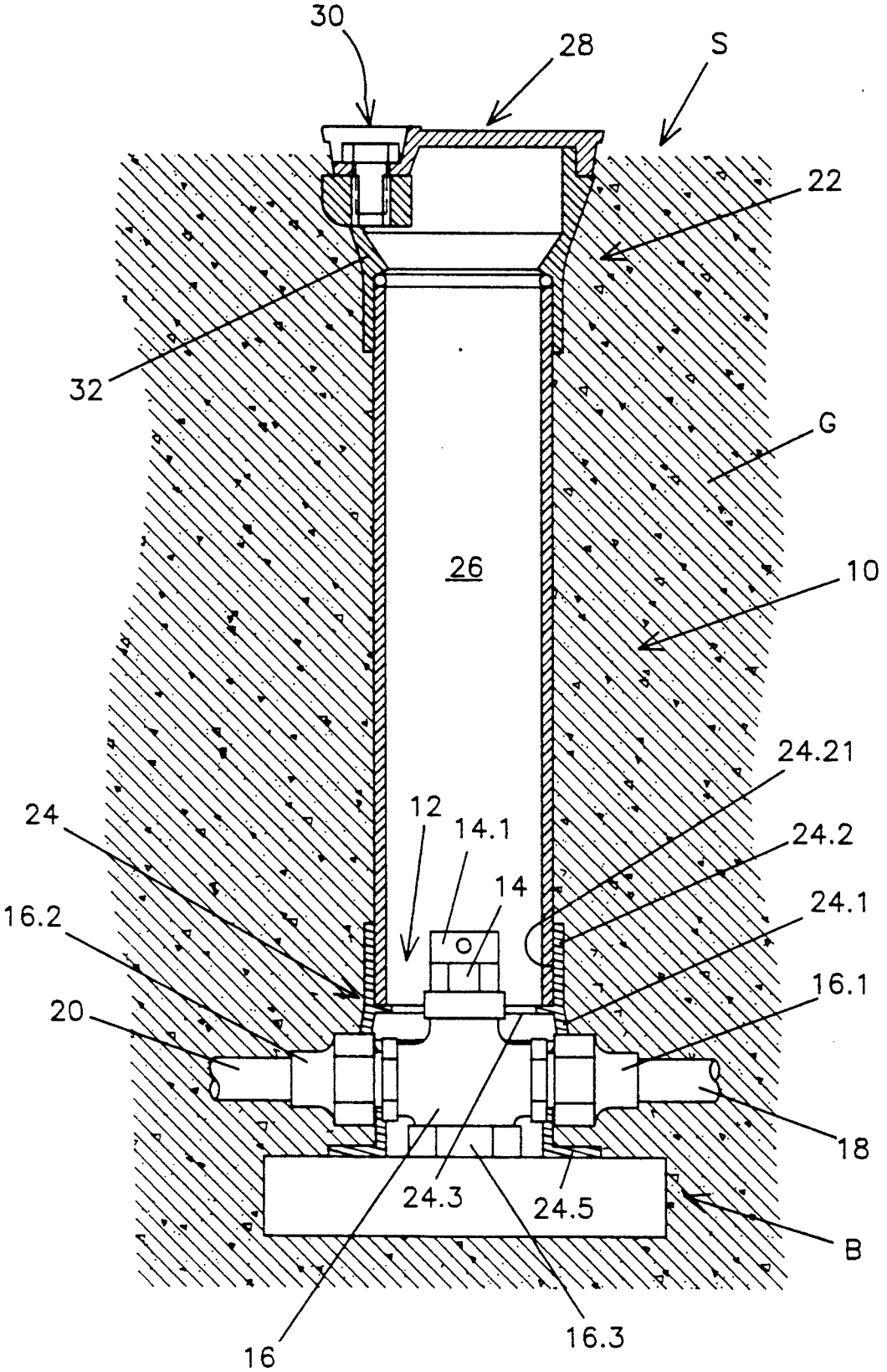
FIG. 5 is a view similar to FIG. 1, but showing all the parts in their assembled and installed position.

First, with reference to FIG. 5, the valve service box formed by the kit of this invention is indicated generally at 10. The valve service box is utilized to provide access to a service pipe shut-off valve assembly indicated generally at 12, which valve assembly is disposed below the surface S of the ground, the valve assembly 12 typically being supported upon a base support B which may be in the form of two side-by-side bricks. When the valve service box is properly assembled with the service pipe shut-off valve assembly they will be positioned in the manner shown in FIG. 5. The service pipe shut-off valve assembly includes a shut-off valve 14 having an upwardly projection tongue 14.1 which can be engaged by a rod key (not shown) for turning the valve between its "on" and "off" positions. The shut-off valve 14 is disposed within a valve casing 16 having opposed ends which are connected to inlet and outlet service pipes 18, 20, respectively, via nipples 16.1 and 16.2. The inlet and outlet pipes 18 and 20 form part of a service line which extends between a water or gas main in a street to a building structure such as a residence. In addition, the casing 16 includes a base 16.3.

The kit for making the valve service box of this invention includes two principal components, these being a cover box assembly indicated generally at 22, and an integral plastic service valve housing indicated generally at 24. The cover box assembly and the plastic service valve housing are so designed that they may be assembled to a piece of plastic pipe 26 of uniform diameter which has been cut to be the desired as required for the particular installation. The kit illustrated in this application have been designed to be used with 3 inch polyvinyl chloride schedule 40 pipe. The pipe 26 is not part of the kit. It will be furnished by the installer as it is a common item and is typically found in the service trucks of most installers. Schedule 40 PVC piping is injection molded and has uniform inside and outside diameters throughout its length. These pipes are typically bonded to couplings and pipe joints by means of a conventional solvent welding process which is well know to those skilled in the art. When assembling the kit of this invention the installer will also provide his own solvent for welding the pipe.

Figure 1:
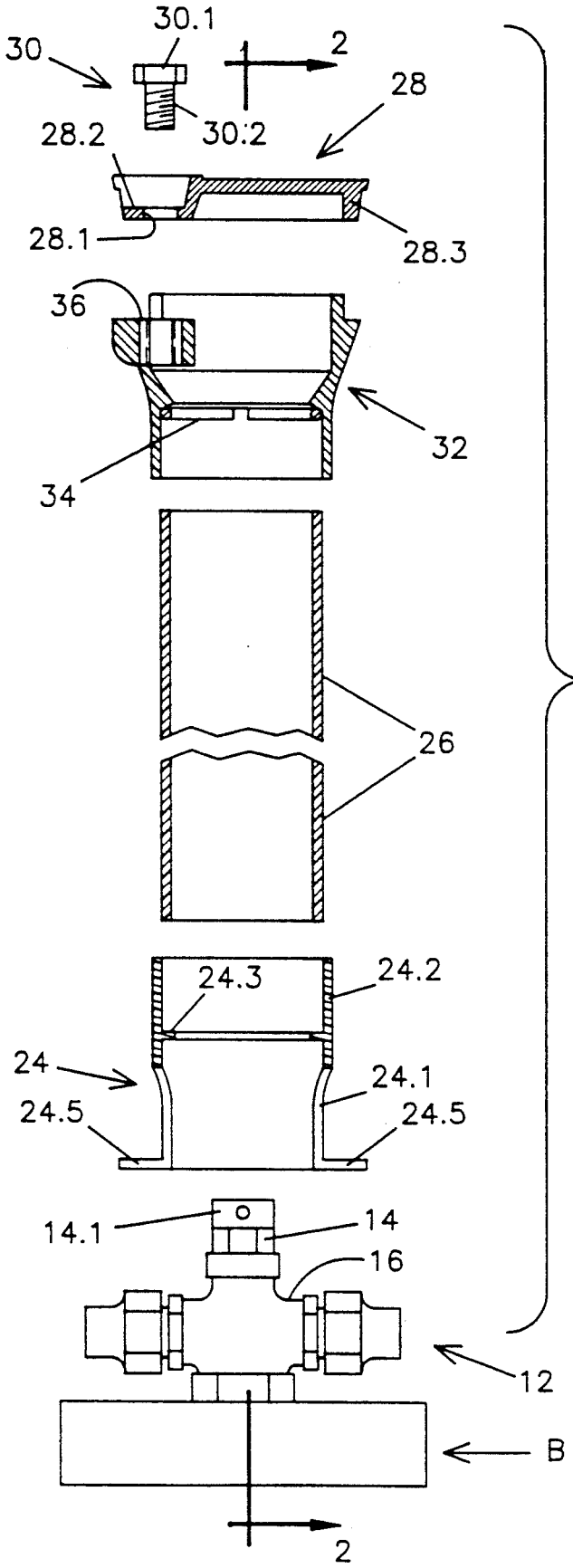
FIG. 1 is a sectional view of the service box kit of this invention showing it in its disassembled state, but also showing it with a length of plastic pipe to which it will be assembled, and also showing it with a shut-off valve assembly and its support.
Figure 2:
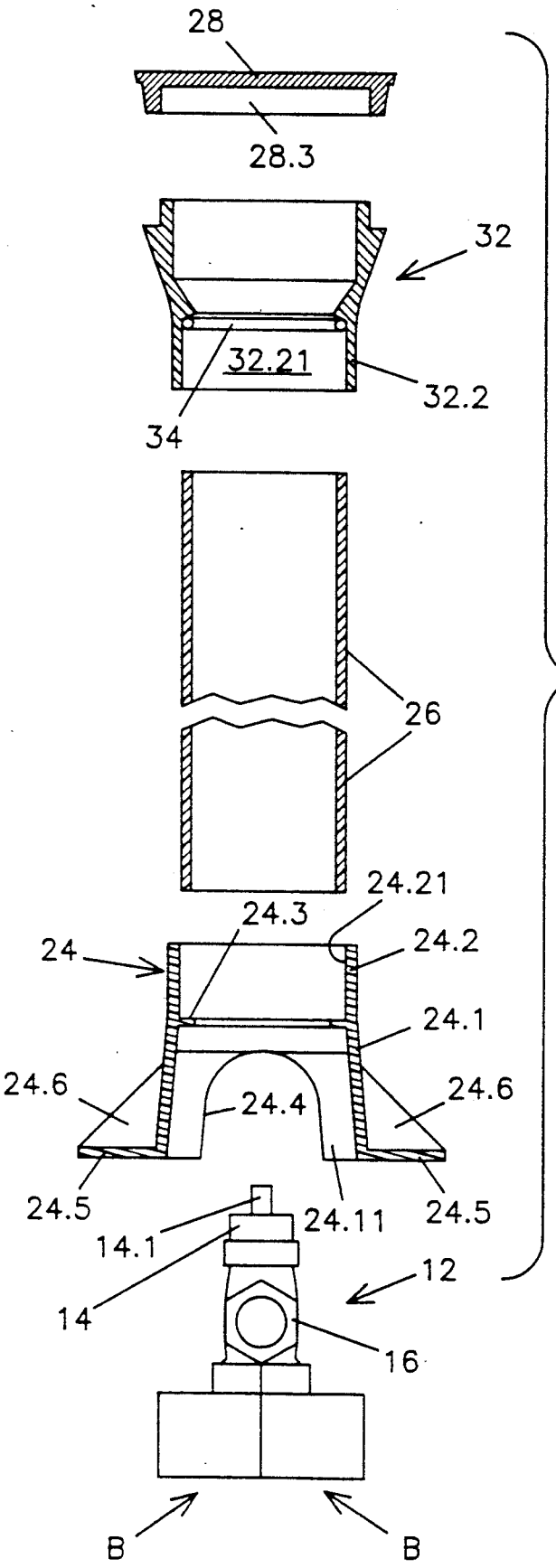
FIG. 2 is a sectional view taken generally along the line 2—2 in FIG. 1.

The cover box assembly is formed from four principal components. As can be seen from FIG. 1 these components are a cover 28, a fastener 30, a plastic cover housing 32, and a metal ring 34, which ring is disposed within the housing 32. The cover 28 is of a conventional cast iron construction and includes an aperture 28.1 in a recessed portion 28.2. The cover further includes a downwardly extending flange 28.3. The fastener is a conventional brass bolt having a head 30.1 and a threaded shank 30.2.

Figure 3:
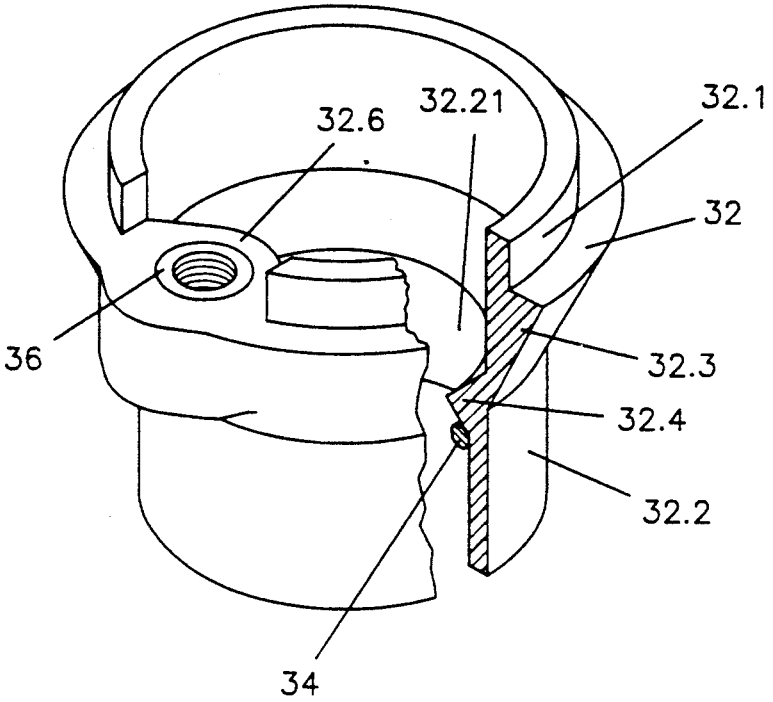
FIG. 3 is a perspective view of the plastic cover housing of the service box kit shown in FIG. 1, this view being partially in section.
Figure 3A:
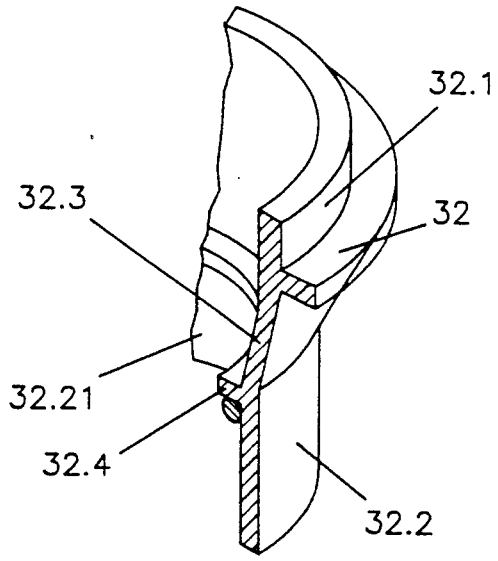
FIG. 3A is a partial sectional perspective view of the preferred form of the plastic cover housing of the service kit of this invention.
Figure 2A:
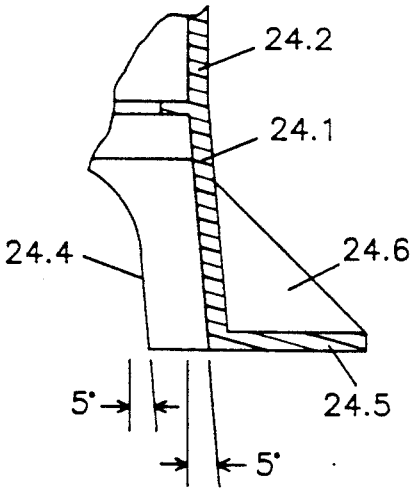
FIG. 2A is an enlarged view of a portion of the structure shown in FIG. 2.
Figure 4:
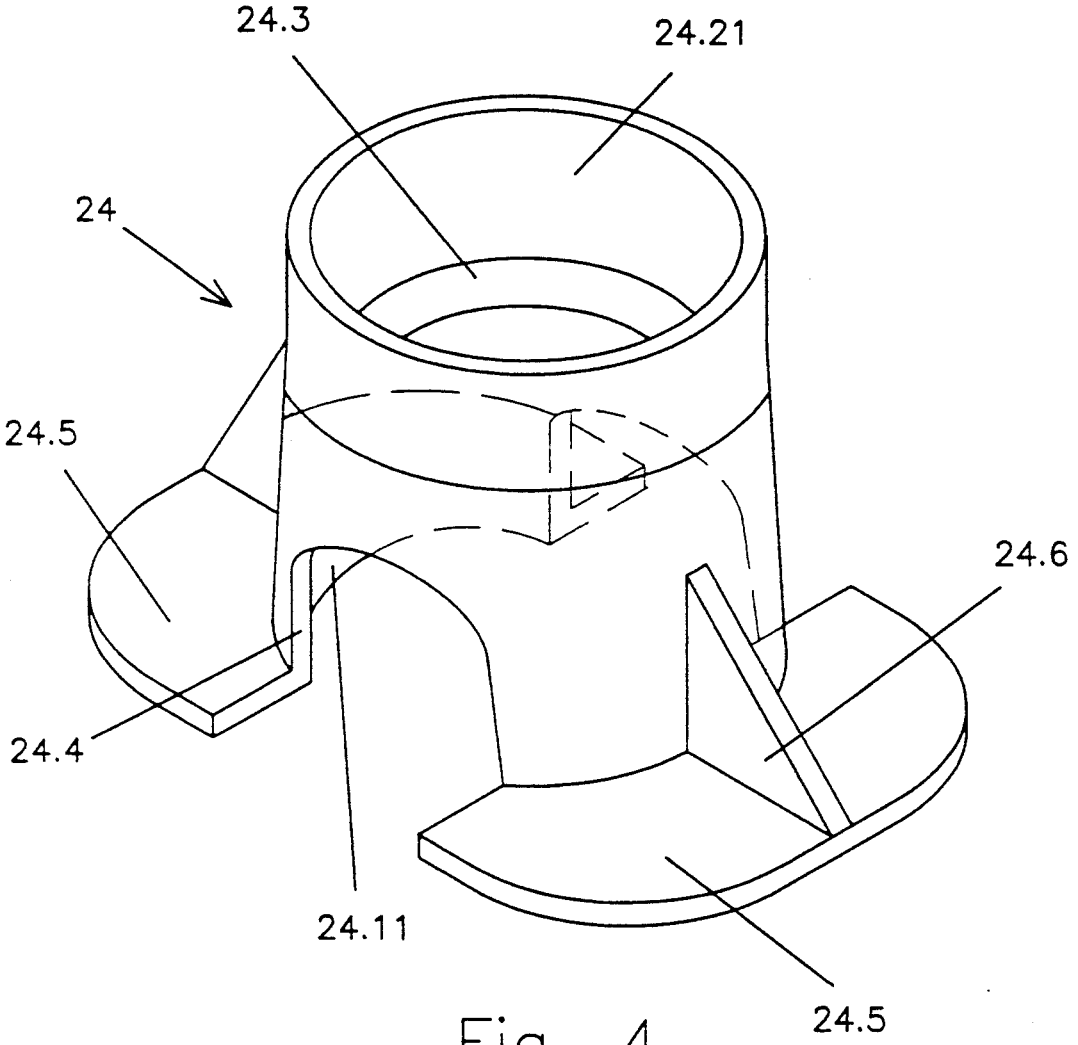
FIG. 4 is a perspective view of the plastic service valve housing of this invention.

The plastic cover housing 32 is preferably molded from rigid polyvinyl chloride. Two separate forms of plastic cover housing are illustrated in FIGS. 3 and 3A, the design being shown in FIG. 3A being the preferred embodiment. However, as these two designs are essentially the same they will be described together. A plastic cover housing of this invention has upper and lower cylindrical portions 32.1, 32.2, respectively. A tapered transition portion 32.3 extends between the upper and lower cylindrical portions. The lower cylindrical portion 32.2 is provided with a cylindrical smooth wall bore 32.21, which bore is adapted to closely receive the upper end of the plastic pipe 26. Disposed within the lower cylindrical portion 32.2 is a radially inwardly extending stop abutment 32.4, the stop abutment being disposed immediately above the cylindrical smooth wall bore 32.21. The plastic cover housing further includes a radially outwardly extending flange 32.5, which flange is disposed below the top rim of the upper cylindrical portion 32.1. The plastic cover housing is additionally provided with a radially inwardly extending fastener receiving portion 32.6, which portion is disposed between the top of the flange 32.5 and the top of the stop abutment 32.4. The fastener receiving portion 32.6 may be provided with a threaded metallic insert 36.

The metallic ring 34 is preferably formed of chrome plated steel wire, the ring being formed with a gap, and the outside diameter of the ring normally being slightly greater than the diameter of the smooth wall bore portion 32.21. The ring 34 may be radially compressed an amount sufficient for it to be inserted within the smooth wall bore portion 32.21, the ring being positioned against the stop abutment 32.4 in the manner shown in the drawings. The purpose of the metal ring is to permit the valve service box 10 to be found after installation by a conventional metal detector, even if the cast iron cover is missing, and even if the upper portion of the plastic housing having the threaded metallic insert 36 has been sheared off from the lower tubular portion. The stop abutment 32.4, acting through the metal ring 34, limits the amount the end of the pipe 36 may be inserted into the plastic cover housing 32 before the upper end of the pipe 26 is solvent welded to the plastic cover housing.

The plastic valve service housing 24 includes a lower bell portion 24.1 and an upper portion 24.2. While not shown, a transition portion may be provided between the lower bell portion 24.1 and an upper portion 24.2. The upper portion 24.2 has a cylindrical smooth wall bore 24.21 which is of the same diameter as the lower cylindrical smooth wall bore 32.21 of the plastic cover housing 32. A radially inwardly extending flange or stop abutment 24.3 is disposed immediately below the cylindrical smooth wall bore 24.21. The bore 24.21 is so dimensioned that it may closely receive the lower end of the pipe 26. The stop abutment 24.3 will limit the amount the end of the pipe 26 may be inserted into the plastic service valve housing. The bell portion 24.1 has a rim 24.11 at its lower end. Opposed recesses 24.2 extend upwardly from the rim 24.11. As can be best seen from FIG. 5, the ends of the service pipe shut-off valve assembly 12 pass through the recesses. The plastic housing 24 further includes a pair of feet 24.5 which extend radially outwardly from the rim 24.11, the feet being disposed between the opposed recesses 24.4. The feet are reinforced by gussets 24.6. The plastic service valve housing 24 is made from injection molded polyvinyl chloride, schedule 40. In order to facilitate the molding of this part, the bell housing is provided with a 5° taper. In addition, the side walls of the recesses 24.4 are also provided with a 5° taper.

When the valve casing 16 is connected to inlet pipes 18, 20, via nipples 16.1 and 16.2 and with the base 16.3 of the valve casing resting upon suitable supports in the ground, such as bricks B, the installer will then measure the vertical distance between grade surface S and the top of the base B. After this distance is known, a suitable length of PVC pipe 26 will be cut. One end of the cut pipe 26 will then be slid into the plastic service valve housing 24 until it abuts stop 24.3, the end of the pipe 26 then being solvent welded therein by a conventional solvent welding process. The other end of the pipe 26 will also be secured in a similar manner within the lower cylindrical portion 32.2 of the plastic cover housing with the upper end of the pipe 26 abutting against the ring 34 (which ring has previously been abutted against the stop abutment 32.4). After the parts have been solvent welded together, the entire assembly may be positioned in the ground with the end portions of the valve casing being received within the apertures 24.4 of the plastic housing 24, and with the feet 24.5 of the housing resting upon the upper surface of the valve casing support B. It is now only necessary to backfill about the valve service box in a conventional manner.

The valve service box kit of this invention has many obvious advantages over that know in the prior art. Initially, it is considerably less costly than other valve service boxes since it is only necessary for the installed to carry a single size for all installations. Thus, the varying distances between final grade surface and the base of the valve casing are accommodated by cutting a standard PVC pipe in the field to the appropriate length and to then solvent weld the parts together. Also, it is well recognized that PVC pipe and fittings are not subject to corrosion as is cast iron, and parts formed of PVC are of relatively light weight when compared to cast iron. Another advantage is that it is easy to clean the inside of the valve service box made by the kit of this invention. A further advantage of this kit is that it is easier to store prior to use since it takes up considerably less space than prior art service box assemblies. As the valve service box of this invention is made of a material which does not rust it can be reused.

Because PVC pipe is used between the plastic valve service housing and the cover box assembly, the overall length can be varied easily after installation. Thus, if the land is regraded to a higher level after initial installation, it is only necessary to cut the PVC pipe, add an appropriate length and to connect the two cut lengths to the additional length of PVC pipe by suitable PVC pipe couplings. Similarly, if the land is regraded to a lower lever, it is only necessary to cut out a suitable length of the PVC pipe within the valve service box, and then to couple the remaining portions of the pipe together with a conventional PVC pipe coupling.

With prior art cast iron installations, if the valve service box is located more than five feet below grade surface, it was necessary to employ an extension. When an extension is employed there is a further movable cast iron joint, which is additional to the movable cast iron joint formed between the threaded top and bottom sections. Due to the looseness of cast iron joints, it is possible that a rod key would not line-up with the tongue 14.1 after the various parts had been assembled in the field.

Finally, the plastic service valve housing of this invention has a bell 24.1 of a relatively shallow depth compared to the prior art. In addition, the internal diameter of the desired three inch PVC pipe is greater than the internal diameter of prior art conventional three inch service boxes. Because of these features it is possible to extend the tongue 14.1 into the pipe 26. This insures that it will be easier to center the rod key onto the valve, whereas it has not always been possible when using prior art valve service boxes.

While preferred forms of this invention have been described above and shown in the accompanying drawings, it should be understood that the applicant does not intend to be limited to the particular details described above and illustrated in the accompanying drawings, but intends to be limited only to the scope of the invention as defined by the following claims.

What is claimed is:

1. A method of making a valve service box for a service pipe shut-off valve assembly disposed below the surface of the ground, the valve assembly being secured at either end to inlet and outlet service pipes; said method comprising the follow steps:

providing a plastic service valve housing having a bell portion provided with opposed recesses, the recesses extending upwardly from the rim at the bottom of the bell portion, the plastic service valve housing also having an upper cylindrical smooth wall bore;

providing a length of plastic pipe of uniform diameter which may be securely bonded to the upper cylindrical smooth wall bore of the plastic service valve housing by a conventional solvent welding process in a fluid tight manner;

providing a cover box assembly including a plastic cover housing having a lower cylindrical smooth wall bore adapted to receive an end of the plastic pipe which may be secured thereto by a conventional solvent welding process in a fluid tight manner;

cutting the length of plastic pipe so that it will be of the desired length between the surface of the ground and the service valve housing when properly positioned about the shut-off valve below the surface of the ground;

bonding one end of the length of pipe within the upper cylindrical smooth wall bore of the service valve assembly; and bonding the lower cylindrical smooth wall bore of the plastic cover housing to the upper end of the plastic pipe to form a valve service box.

2. A kit for forming a valve service box, the kit having component parts capable of being assembled in the field with a length of plastic pipe of a suitable uniform diameter to form a valve service box for a service pipe shut-off valve assembly having a shut off valve disposed within a valve casing having opposed ends, the ends of the casing being secured to suitable service pipes disposed below ground surface; the kit comprising:

a plastic service valve housing for receiving a service pipe shut-off valve assembly secured to a pair of service pipes, said service valve housing having a bell portion which is provided with a rim at its lower end and opposed recesses extending upwardly from the rim of the bell, the service valve housing also having an upper cylindrical smooth wall bore adapted to closely receive the lower end of a length of plastic pipe of a suitable diameter for coupling thereto by a conventional solvent welding process; and a cover box assembly comprising a plastic cover housing, a cover, fastener means for securing the cover to the plastic cover housing, and wherein the plastic cover housing further includes a lower cylindrical smooth wall bore of the same diameter as the upper cylindrical smooth wall bore of the plastic service valve housing, the lower cylindrical smooth wall bore being adapted to closely receive the upper end of the length of the plastic pipe for coupling thereto by a conventional solvent welding process.

3. A cover box assembly for a valve service box forming kit which also includes a plastic service valve housing, the cover box assembly and the plastic service valve housing capable of being assembled in the field with a length of plastic piping of a suitable uniform diameter to form a valve service box for a service pipe shut-off valve disposed below the surface of the ground; the cover box assembly comprising:

a plastic cover housing having a lower cylindrical smooth wall bore adapted to closely receive the upper end of a length of plastic piping for coupling thereto by a conventional solvent welding process, a radially inwardly extending abutment disposed immediately above the lower cylindrical smooth wall bore, an upper cylindrical portion adapted to receive a cover, a transition portion extending between the lower cylindrical portion and the upper cylindrical portion, and fastener receiving means;

a cover provided with an aperture; and fastener means which pass through the aperture in the cover and which has an end received within the fastener receiving means in the plastic cover housing to secure the cover to the cover housing.

4. The cover box assembly for a valve service box forming kit as set forth in claim 3 wherein the plastic cover housing further includes a radially outwardly extending flange disposed below the top of the upper cylindrical portion, wherein the cover further includes a downwardly extending cylindrical flange which is adapted to be disposed about the upper cylindrical portion and to abut against said radially outwardly extending flange when the cover is assembled to the plastic cover housing, wherein the fastener receiving means of the plastic cover housing extends radially inwardly extending between the top of the radially outwardly extending flange and the top of the radially inwardly extending abutment, and wherein the radially inwardly extending fastener receiving means is provided with a threaded metallic insert molded therein.

5. The cover box assembly for a valve service box forming kit as set forth in claim 3 wherein the assembly further includes a ferrous metal ring disposed within the lower cylindrical portion immediately below the radially inwardly extending abutment.

6. A one piece integral plastic service valve housing for a valve service box forming kit which also includes a cover box assembly, the cover box assembly and the service valve housing capable of being assembled in the field with a suitable length of plastic pipe of an appropriate uniform diameter to form a valve service box for a service pipe shut-off valve assembly disposed below the surface of the ground, the service pipe shut-off valve assembly having a shut off valve disposed within a valve casing having opposed ends, the ends of the casing being secured to suitable service pipes disposed below ground surface; the service valve housing including:

an upper portion having a cylindrical smooth wall bore adapted to receive therein the lower end of a length of plastic pipe of an appropriate diameter for coupling thereto by a conventional solvent welding process, a radially inwardly extending abutment disposed immediately below the smooth cylindrical bore, and a bell portion disposed below the upper portion, the bell portion being adapted to receive therein the service pipe shut-off valve assembly.

7. A one piece integral plastic service valve housing for a valve service box forming kit which also includes a cover box assembly, the cover box assembly and the service valve housing capable of being assembled in the field with a suitable length of plastic pipe of an appropriate uniform diameter to form a valve service box for a service pipe shut-off valve assembly disposed below the surface of the ground, the service pipe shut-off valve assembly having a shut off valve disposed within a valve casing having opposed ends, the ends of the casing being secured to suitable service pipes disposed below ground surface; the service valve housing including:

an upper portion having a cylindrical smooth wall bore adapted to receive therein the lower end of a length of plastic pipe of an appropriate diameter for coupling thereto by a conventional solvent welding process, a radially inwardly extending abutment disposed immediately below the smooth cylindrical bore, and a bell portion disposed below the upper portion, the bell portion being adapted to receive therein the service pipe shut-off valve assembly, the bell portion having a lower rim, opposed recesses through which the ends of the valve casing may pass, the opposed recesses extending upwardly from the rim of the bell portion, a pair of feet extending radially outwardly from the rim of the bell portion, said feet being disposed between the opposed recesses, and a pair of reinforcing gussets, each gusset extending between the upper surface of one of the feet and an outer side wall of the bell portion, each of said pair of gussets being disposed midway between the opposed recesses.

8. A valve service box comprising:

a one piece plastic service valve housing having a bell portion having opposed recesses for the reception of the ends of a shut-off valve assembly disposed within the bell portion, an upper portion interconnected with the bell portion, the upper portion having a cylindrical smooth wall bore, and a radially inwardly extending abutment disposed immediately below the cylindrical smooth wall bore;

a length of plastic pipe of uniform diameter which has been cut to be of the desired length, the lower end of the plastic pipe being bonded within the cylindrical smooth wall bore of the upper portion of the plastic service valve housing;

a cover box assembly adapted to be disposed at the surface of the ground, the cover box assembly including a plastic cover housing having a lower cylindrical smooth wall bore which is bonded about the upper end of the length of plastic pipe, an upper cylindrical portion interconnected with the lower cylindrical bore, and fastener receiving means, a cover provided with an aperture, and fastener means which pass through the aperture in the cover and which has an end received within the fastener receiving means in the plastic cover housing to secure the cover to the plastic cover housing.

* * * * *